US010755610B1

(12) United States Patent
Zhao

(10) Patent No.: US 10,755,610 B1
(45) Date of Patent: Aug. 25, 2020

(54) CONNECTORS FOR DISPLAY FRAME

(71) Applicant: Lei Zhao, Azusa, CA (US)

(72) Inventor: Lei Zhao, Azusa, CA (US)

(73) Assignee: Lei Zhao, Azusa, CA (US)

( * ) Notice: Subject to any disclaimer, the term of this patent is extended or adjusted under 35 U.S.C. 154(b) by 0 days.

(21) Appl. No.: 16/424,275

(22) Filed: May 28, 2019

(51) Int. Cl.
*G09F 15/00* (2006.01)

(52) U.S. Cl.
CPC ..... *G09F 15/0012* (2013.01); *G09F 15/0068* (2013.01)

(58) Field of Classification Search
CPC ..... G09F 15/0012; G09F 15/0068; G09F 15/0018; F16B 7/046; F16B 7/0473; F16B 2/185; E05C 5/00
See application file for complete search history.

(56) References Cited

U.S. PATENT DOCUMENTS 3,192,820 A * 7/1965 Pitzer ..... F16B 13/065 411/33
5,368,347 A * 11/1994 Holtman ..... E05B 65/006 292/1
5,590,921 A * 1/1997 Holtman ..... E05B 65/006 292/257
9,788,668 B2 * 10/2017 McPhillips ..... A47F 5/10
2007/0138350 A1 * 6/2007 Brown ..... F16L 3/2431 248/65
2014/0197124 A1 * 7/2014 McPhillips ..... G09F 15/0068 211/195
2014/0259622 A1 * 9/2014 Alkas ..... G09F 15/0068 29/525.01
2017/0121972 A1 * 5/2017 Mountfort ..... E04B 1/40
2017/0171991 A1 * 6/2017 McPhillips ..... G09F 9/3026

* cited by examiner

*Primary Examiner* — Gary C Hoge
(74) *Attorney, Agent, or Firm* — Elizabeth Yang

(57) ABSTRACT

A display frame includes at least one supporting frame having a receiving slot; at least one connector having a main portion and at least two connecting portions rotatably arranged on the main portion; wherein the connecting portions can slide along the receiving slot to lock the connecting portion of the supporting frame.

11 Claims, 18 Drawing Sheets

CONNECTORS FOR DISPLAY FRAME

FIELD OF THE DISCLOSURE

The present disclosure relates to a display frame, and more particularly to, a plurality of connectors and a plurality of supporting frames having the same. Although the present disclosure is suitable for a wide scope of applications, it is particularly suitable for the supporting frames to be connected with each other through the connectors.

BACKGROUND OF THE DISCLOSURE

Generally, a conventional display frame comprises a plurality of supporting frames configured to be connected to form a plurality of square or rectangular shaped frames, wherein the square or rectangular shaped frames can be configured for holding sale signs, advertisements, and real estate signs.

Many structures have been proposed to support the connections between the plurality of supporting frames. Tubular plastic supporting frames are well known for its intended purposes. For example, two of the tubular plastic supporting frames can be coupled to form a framework to suspend and hold the objects. However, two of the tubular plastic supporting frames are pressed to be connected, so the area of intersection between two tubular plastic supporting frames may be deformed.

Another way to connect a plurality of supporting frames is to utilize screws, wherein the screws are screwed into the supporting frames for fixing the supporting frames. However, the surface of each of the supporting frames is injured. Furthermore, a fixing tool, such as a screwdriver is needed, causing inconvenience during assembly. Additionally, if a screw is lost, a gap appears at the area of intersection between two supporting frames while reassembling the supporting frame.

There may exist a desire to develop a connector for connecting the two adjacent frames, and the area of intersection between two supporting frames won't be damaged during assembling.

All referenced patents, applications, and literature are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned desires. Although the present embodiments may obviate one or more of the above-mentioned desires, it should be understood that some aspects of the embodiments might not necessarily obviate them.

BRIEF SUMMARY OF THE DISCLOSURE

In a general implementation, display frame includes at least one supporting frame having a receiving slot; at least one connector comprises a main portion and at least two connecting portions rotatably arranged on the main portion; wherein the connecting portions can slide along the receiving slot to lock the connecting portion of the supporting frame.

In another aspect combinable with the general implementation, at least the two connecting portions can be operated to affix with two separate supporting frames respectively, so as to connect two supporting frames.

In another aspect combinable with the general implementation, at least one of the connecting portions comprises a middle portion, an operating element pivotally connected on the side of the middle portion, a retaining portion integrally extended from an opposite side of the middle portion.

In another aspect combinable with the general implementation, at least one of the main portion comprises at least one connecting through hole configured to receive the middle portion of the connecting portion.

In another aspect combinable with the general implementation, at least one of the middle portion of the connecting portion is passed through the connecting through hole, and is rotatably received in the connecting through hole.

In another aspect combinable with the general implementation, at least one of the retaining portion has a size larger than a diameter of the connecting through hole.

In another aspect combinable with the general implementation, at least one of the main portion comprises a top surface and a bottom surface, wherein the retaining portion can be operated to biased against the bottom surface of the main portion.

In another aspect combinable with the general implementation, at least one of the retaining portion is an elongated block, wherein the retaining portion can be vertically inserted into the receiving slot and slide along with the receiving slot to a corresponding location, and then the retaining portion can be rotated in 90 degrees in a horizontal position.

In another aspect combinable with the general implementation, at least one of the operating portion is pushed towards the main portion to lock the retaining portion on the corresponding location.

In another aspect combinable with the general implementation, at least one of the operating portion can be pulled up in a vertical position to release the retaining portion from the receiving slot.

In another aspect combinable with the general implementation, at least one of the portion comprises a first portion and a second portion vertically extended from the first portion, wherein two connecting portions are arranged on endpoints of the first and second portions respectively.

In another aspect combinable with the general implementation, at least one of the main portion comprises a first portion, a second portion vertically extended from the first portion, and a third portion integrally extended from the second portion to form 45 degrees.

In another aspect combinable with the general implementation, at least one of the main portion is an elongated plate.

In another aspect combinable with the general implementation, at least one of the main portion is a T-shaped plate, wherein three connecting portions are arranged on three ends of the T-shaped plate.

In another aspect combinable with the general implementation, at least one of the one connecting portion is arranged on an endpoint of the first portion, and the other connecting portion is arranged on an endpoint of the third portion.

Another aspect of the embodiment is directed to methods of assembling display frames, comprising:

providing at least one supporting frame having a receiving slot formed thereon;

providing at least one connector detachably affixed on one supporting frame;

affixing the at least one connector on the supporting frame to connect two supporting frames.

In another aspect combinable with the general implementation, at least one of the connector comprises at least one connecting portion configurated to affix on the supporting frame, wherein the connecting portion comprises a middle portion, an operating portion pivotally connected to a side of the middle portion, and a retaining portion integrally extended from an opposite side of the middle portion.

In another aspect combinable with the general implementation, at least one of the connector comprises a main portion having at least one connecting through hole for receiving the middle portion of the connecting portion.

In another aspect combinable with the general implementation, the method further comprises a step of sliding the retaining portion along with the receiving slot and pushing the operating portion biased against the main portion to lock the connecting portion with the receiving slot.

In another aspect combinable with the general implementation, the method further comprises a step of pulling up the operating portion to release the retaining portion from the receiving slot.

In another aspect combinable with the general implementation, at least one of the middle portion can be rotatably received inside the connecting through hole.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above and below as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example, operations, methods, or processes described herein may include more steps or fewer steps than those described. Further, the steps in such example, operations, methods, or processes may be performed in different successions than that described or illustrated in the figures. Accordingly, other implementations are within the scope of the following claims.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE EMBODIMENTS

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

Figure 1:
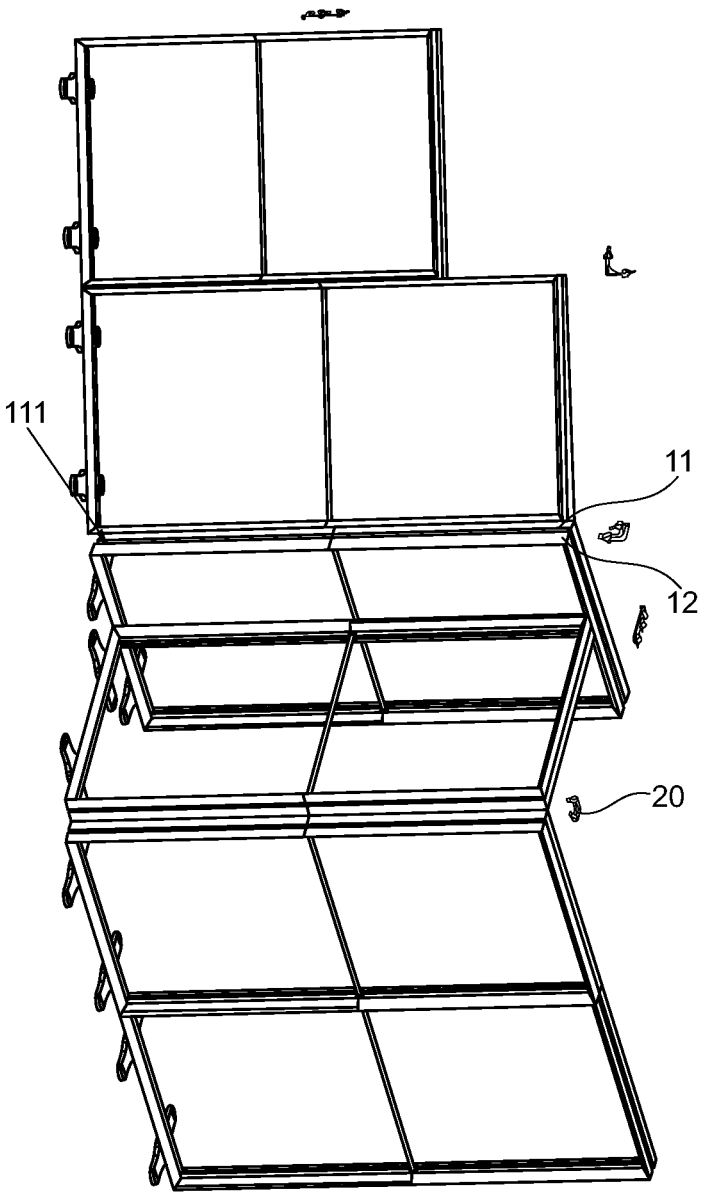
FIG. 1 is a perspective view of a plurality of display frames being connected through a plurality of connectors according to an aspect of the embodiment.
Figure 2:
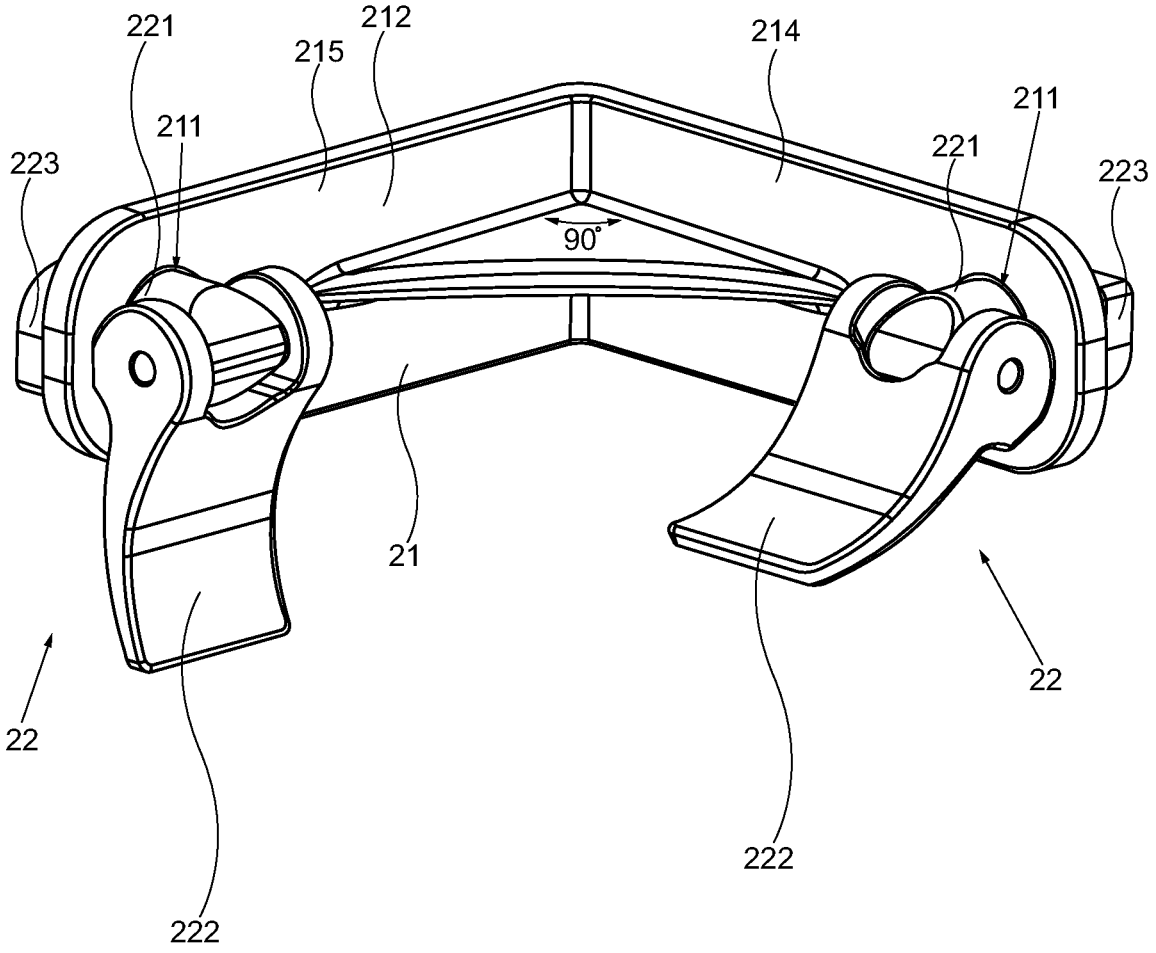
FIG. 2 is another perspective view of a connector according to the aspect of the embodiment.

Referring to FIG. 1 and FIG. 2 of the drawings, a display frame comprises at least one supporting frame 11 having a receiving slot 111 arranged on a top surface 12 of the supporting frame 11, and at least one connector 20 configured to connect at least one supporting frames 11, wherein each of the connectors 20 comprises a main portion 21 and at least two connecting portions 22 rotatably arranged on the main portion 21.

In one embodiment, the connecting portion 22 can be slid along the receiving slot 1111 to lock the connecting portion 22 with the supporting frame 11, wherein two connecting portions 22 of the connector 20 can be locked on two adjacent supporting frames 11 for connecting two adjacent supporting frames 11.

Accordingly, each of the connecting portions 20 comprises a middle portion 221, an operating portion 222 pivotally connected on one side of the middle portion 221, a retaining portion 223 integrally extended from an opposite side of the middle portion 221.

In one aspect, the main portion 21 comprises at least one connecting through hole 211 configured to receive the middle portion 221 of the connecting portion 22, wherein the middle portion 221 of the connecting portion 22 can be rotatably received into the connecting through hole 211. In other words, the middle portion 221 of the connecting portion 22 can pass through the connecting through hole 211.

In another aspect, the retaining portion 223 is an elongated block and has an area larger than a diameter of the connecting through hole 211 of the main portion 21, wherein the retaining portion 223 can be locked on the connecting through hole 211 of the main portion 21.

Figure 3:
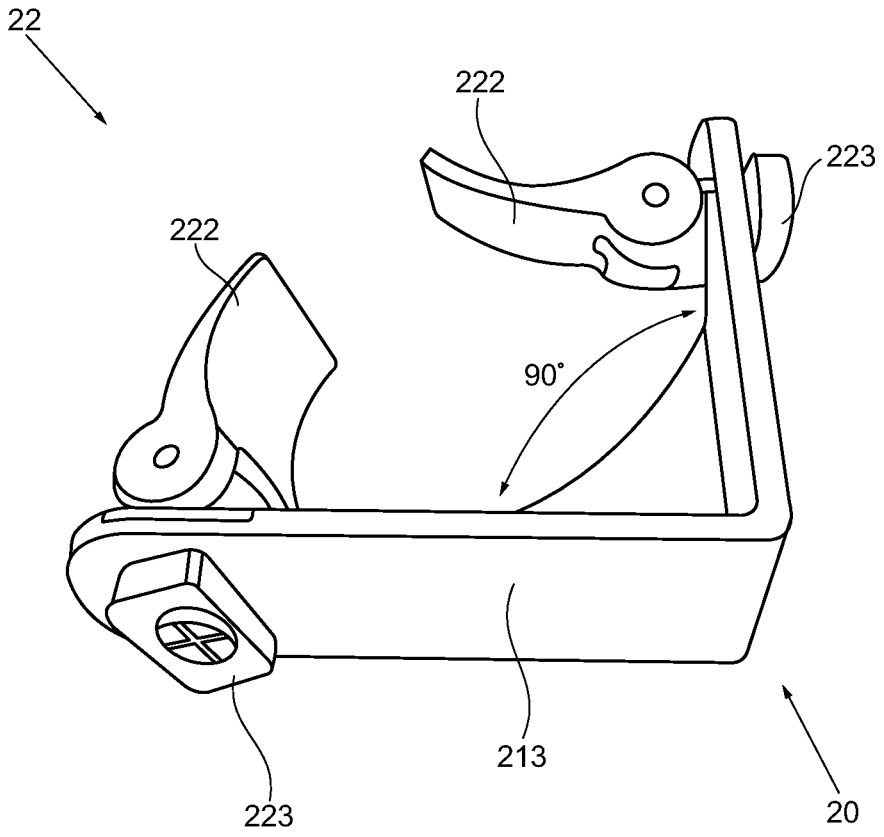
FIG. 3 is a side view of the connector according to the aspect of the embodiment.

In yet another aspect, as shown in FIG. 2 and FIG. 3, the main portion 21 comprises a top surface 212 and a bottom surface 213, wherein the retaining portion 223 can be operated to biased against the bottom surface 213 of the main portion 21.

In still yet another aspect, the operating element 222 is vertically arranged with respect to the main portion 21 of the connecting portion 22, and the retaining portion 223 can be vertically-arranged to insert into the receiving slot 111 and slid along with the receiving slot 111 to a corresponding location, and then the retaining portion 223 can be rotated 90 degrees in a horizontal position. In this manner, the operating element 222 can be pushed towards the main portion 21 to lock the retaining portion 223 on the corresponding location.

Figure 4:
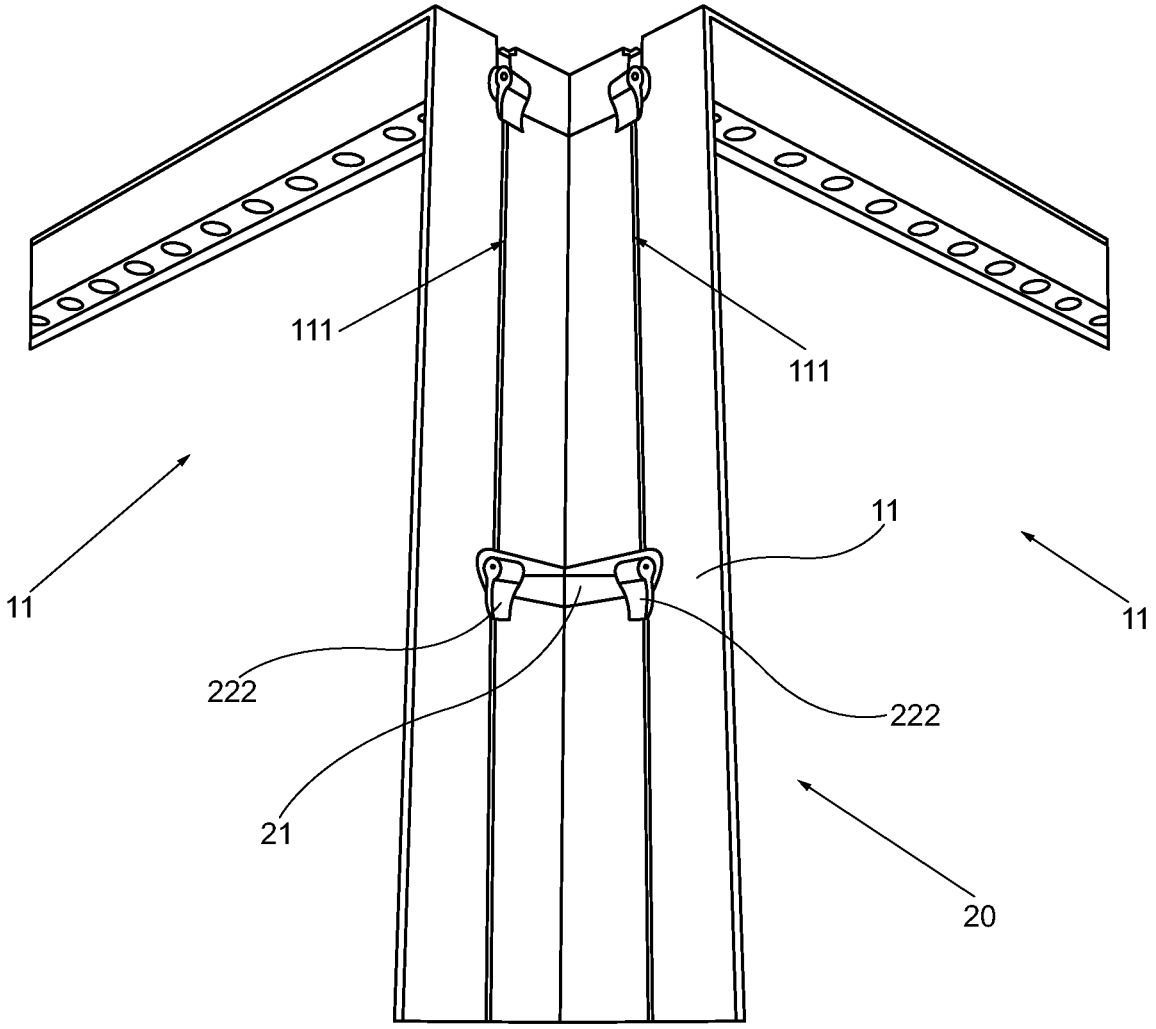
FIG. 4 is a perspective view of the connector according to the aspect of the embodiment, illustrating the connectors being configured to connect with two adjacent supporting frames.

Accordingly, as shown in FIG. 4, two retaining portions 223 of the two connecting portions 22 of the connector 20 can be slid along the two separate receiving slots 111 of two separate supporting frames 11 so that the two separate supporting frames 11 can be connected with the connector 20 through the two connecting portions 22.

In still yet another aspect, the operating element 222 of the connecting portion 22 can be pulled up in a vertical position to release the retaining portion 223 from the receiving slot 111.

In still yet another aspect, the main portion 21 of the connector 22 comprises a first portion 214 and a second portion 215 vertically extended from the first portion 214, wherein two connecting through holes 211 can be arranged on two endpoints of the first and second portions 214, 215 respectively, wherein two connecting portions 22 are arranged on the two endpoints of the first and second portions 214, 215 respectively through two connecting through holes 211. The two connecting portions 22 of the connector 20 can be affixed on the two supporting frames 11 to retain the two supporting frames 11 to form a 90-degree angle.

Figure 5:
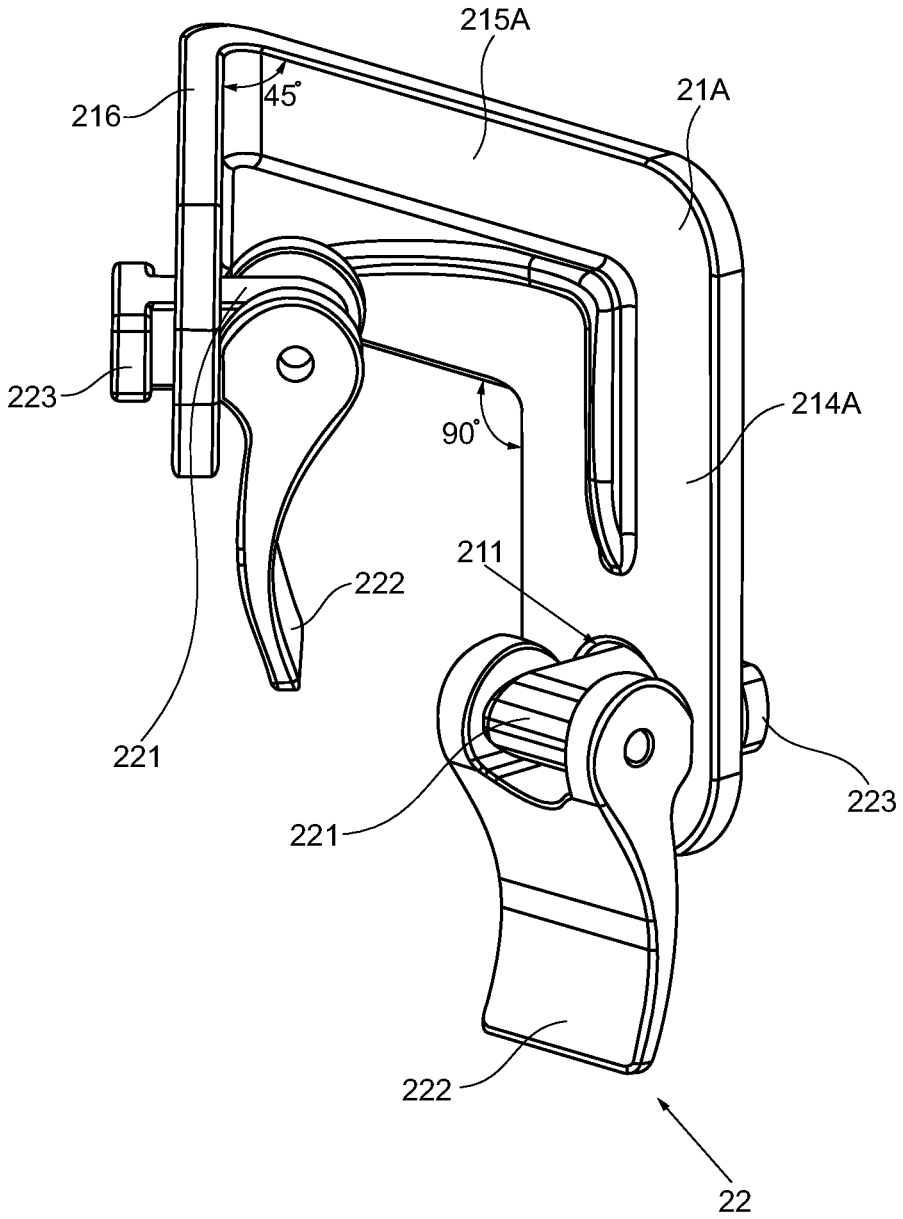
FIG. 5 is a perspective view of a first alternative mode of the connector according to the aspect of the embodiment.
Figure 6:
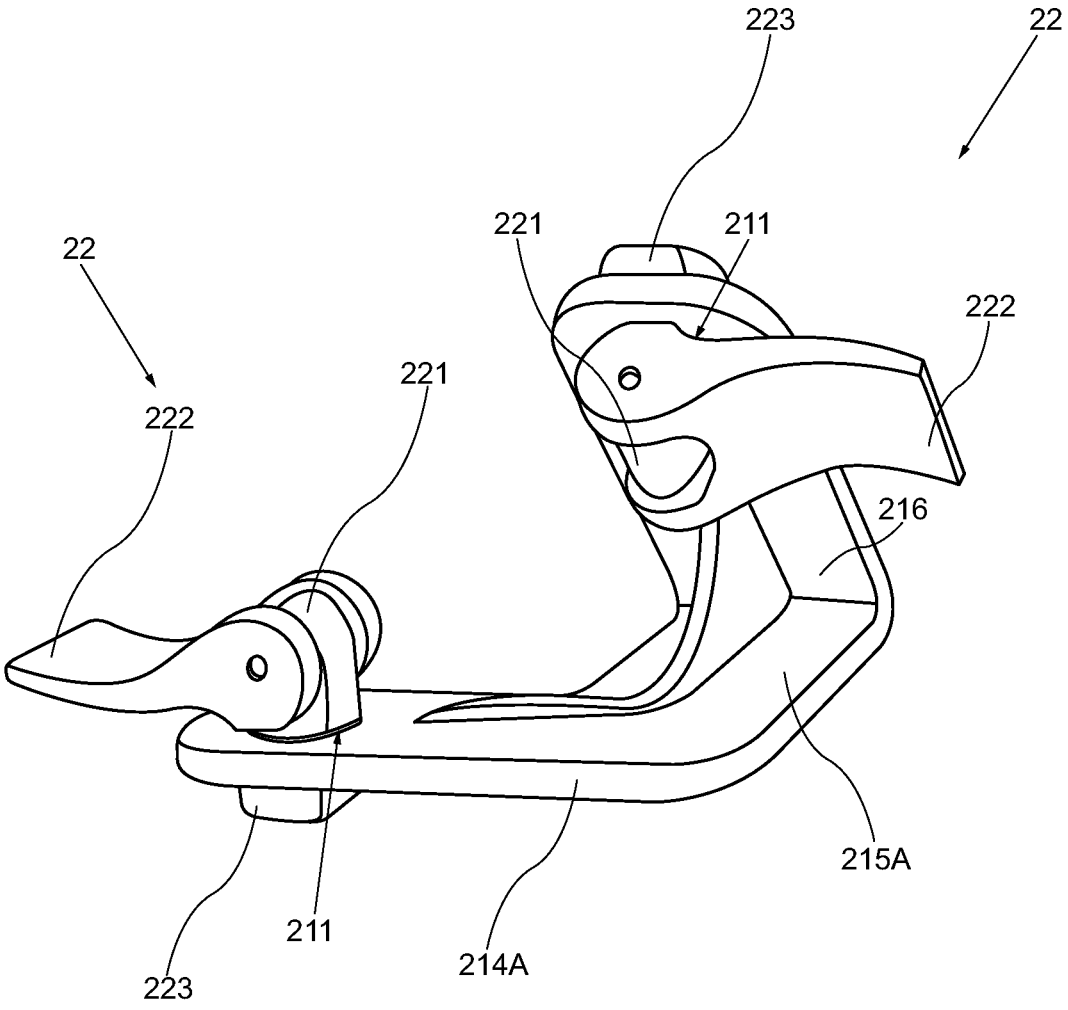
FIG. 6 is another perspective view of the first alternative mode of the connector according to the aspect of the embodiment.
Figure 7:
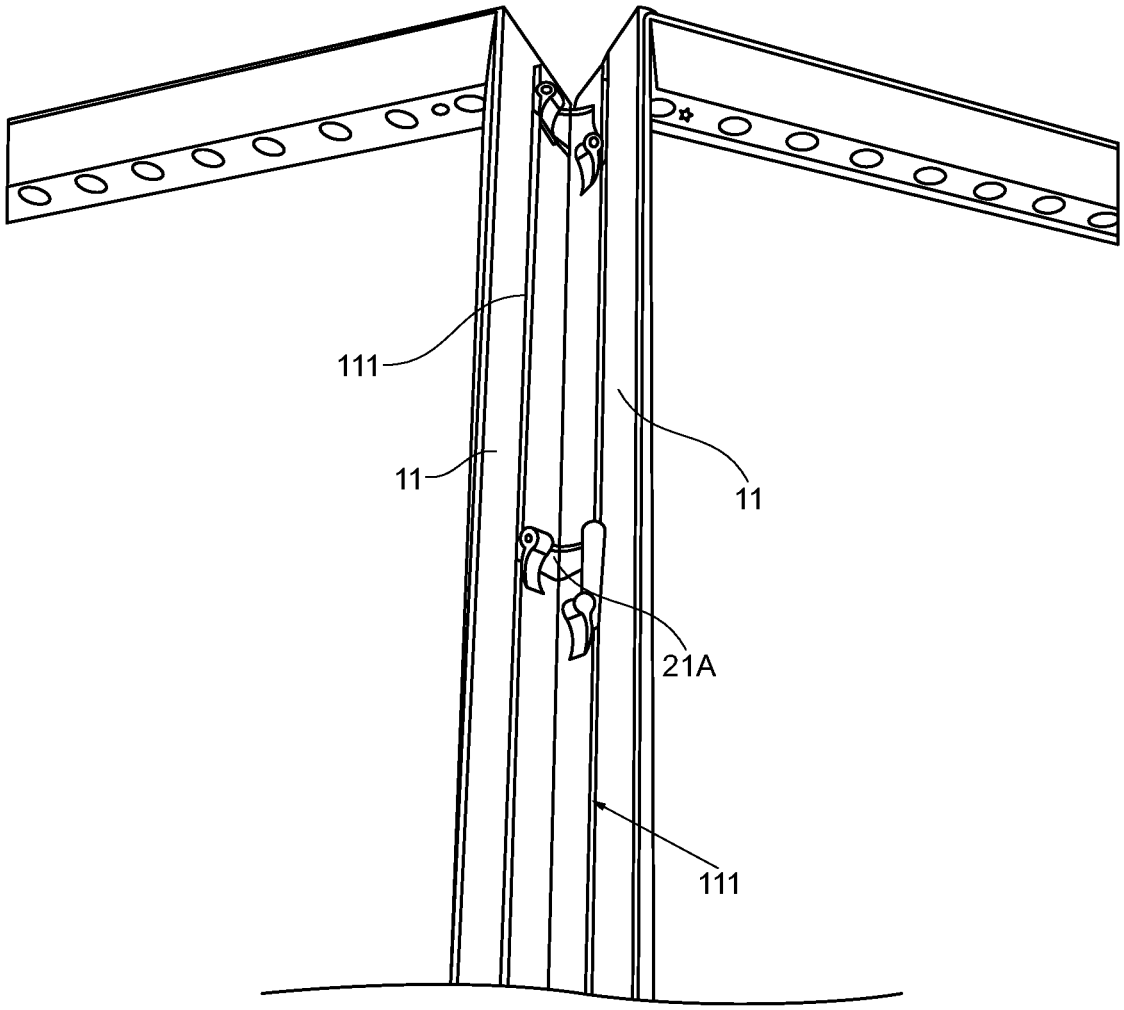
FIG. 7 is a perspective view of the first alternative mode of the main portion of the connector according to the aspect of the embodiment, illustrating the connector being configured to connect with two adjacent supporting frames.
Figure 8:
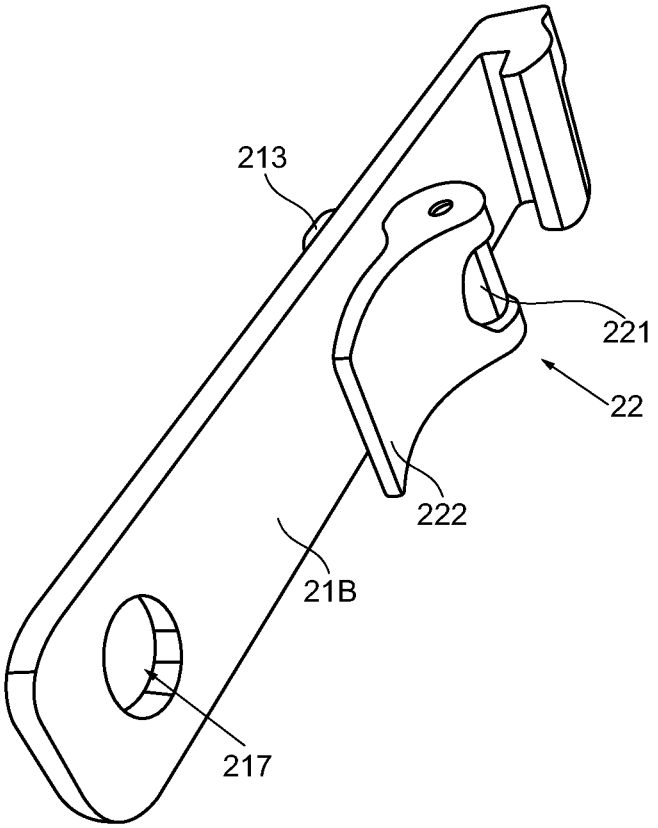
FIG. 8 is a perspective view of a second alternative mode of the main portion of the connector according to the aspect of the embodiment.
Figure 9:
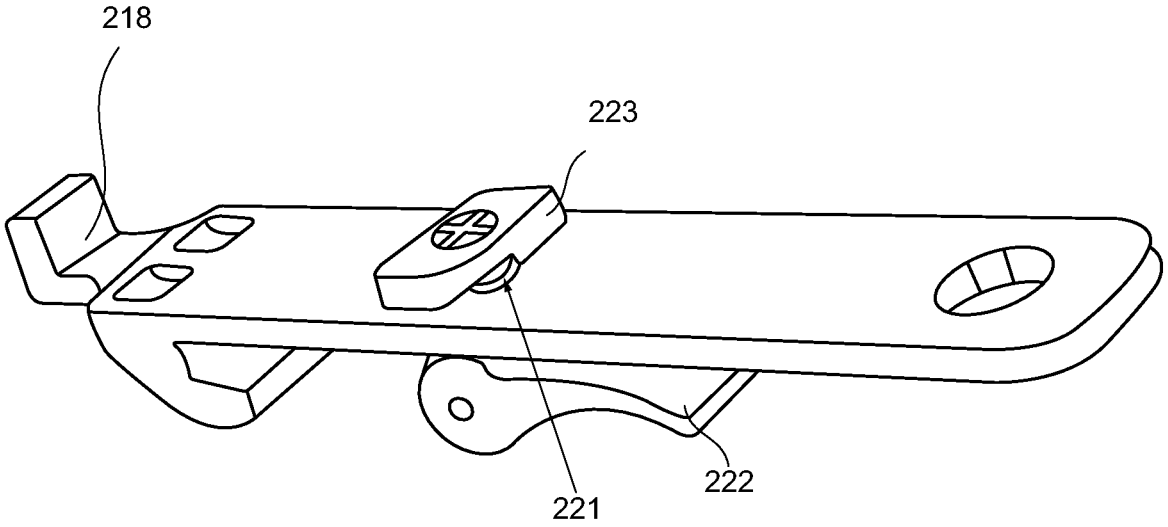
FIG. 9 is a bottom view of the second alternative mode of the main portion of the connector according to the aspect of the embodiment.

In another embodiment, referring to FIGS. 5 to 7, a first alternative mode of the main portion 21A comprises a first portion 214A, a second portion 215A vertically extended from the first portion 214A, and a third portion 216 integrally extended from the second portion 215A to form a 45-degree angle, wherein two connecting through holes 211 are arranged on two endpoints of the first and third portions 214A, 216 respectively, wherein two connecting portions 22 are arranged on two endpoints of the first and third portions 214A, 216 respectively. The two connecting portions 22 of the connector 20 can be affixed on the two supporting frames 11 to retain the two supporting frames 11 to form a 45-degree angle.

In yet another embodiment, as shown in FIGS. 8 to 11, a second alternative mode of the main portion 21B is an elongated plate having at least one connecting through hole 211, wherein at least one connecting portion 22 is arranged on the connecting through hole 211. The main portion 21B is an elongated main portion 21B.

Figure 10:
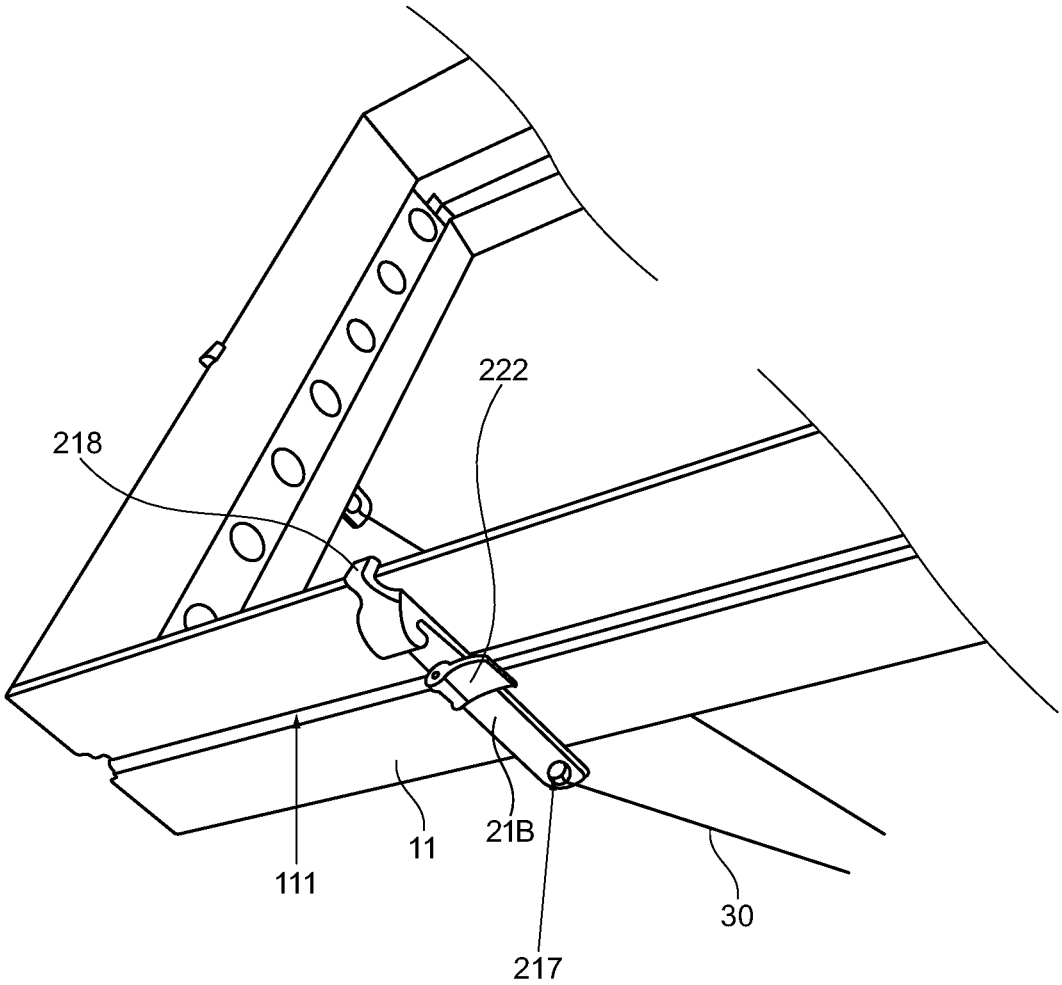
FIG. 10 is a perspective view of the second alternative mode of the connector according to the aspect of the embodiment, illustrating the connector being utilized to suspend the supporting frame.

In one aspect, the elongated main portion 21B further comprises a hanging through hole 217 arranged on one side of the elongated main portion 21B, and a hanger 218 arranged on an opposite side of the elongated main portion 21B. In one embodiment, as shown in FIG. 10, a string 30 can be passed through the hanging through hole 217, and the hanger 218 can be hooked on one side of the supporting frame 11, and the connecting portion 22 on the elongated main portion 21B can be affixed on the receiving slot 111 of the supporting frame 11. In one aspect, the hanger 218 can be hooked with the receiving slot 111 of one supporting frame 11, and at the same time, the connecting portion 22 can be affixed on the receiving slot 111 of the other supporting frame 11, so as to connect the two supporting frames 11.

Figure 11:
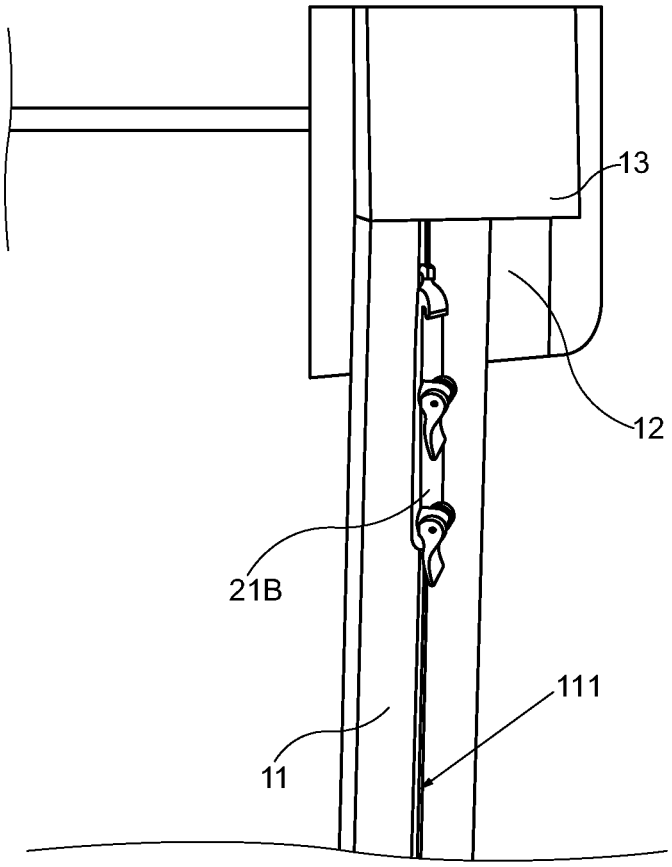
FIG. 11 is a perspective view of the second alternative mode of the main portion of the connector according to the aspect of the embodiment, illustrating the connector being utilized to hang on objects on the supporting frame.

It is worth mentioning that, as shown in FIG. 11, an additional frame 12 can be attached with the supporting frame 11, and the connecting portions 22 of the connector 20 can be configured to connect one supporting frame 11 with the additional frame 12, so as to support objects 13 placing on the additional frame 12.

Figure 12:
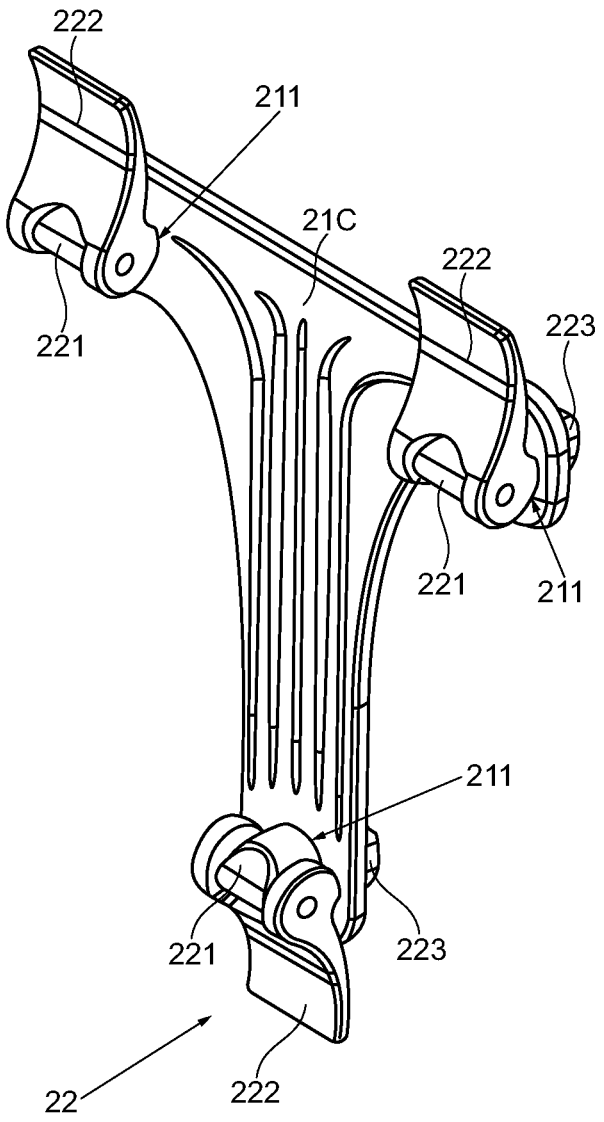
FIG. 12 is a perspective view of a third alternative mode of the main portion of the connector according to the aspect of the embodiment.
Figure 13:
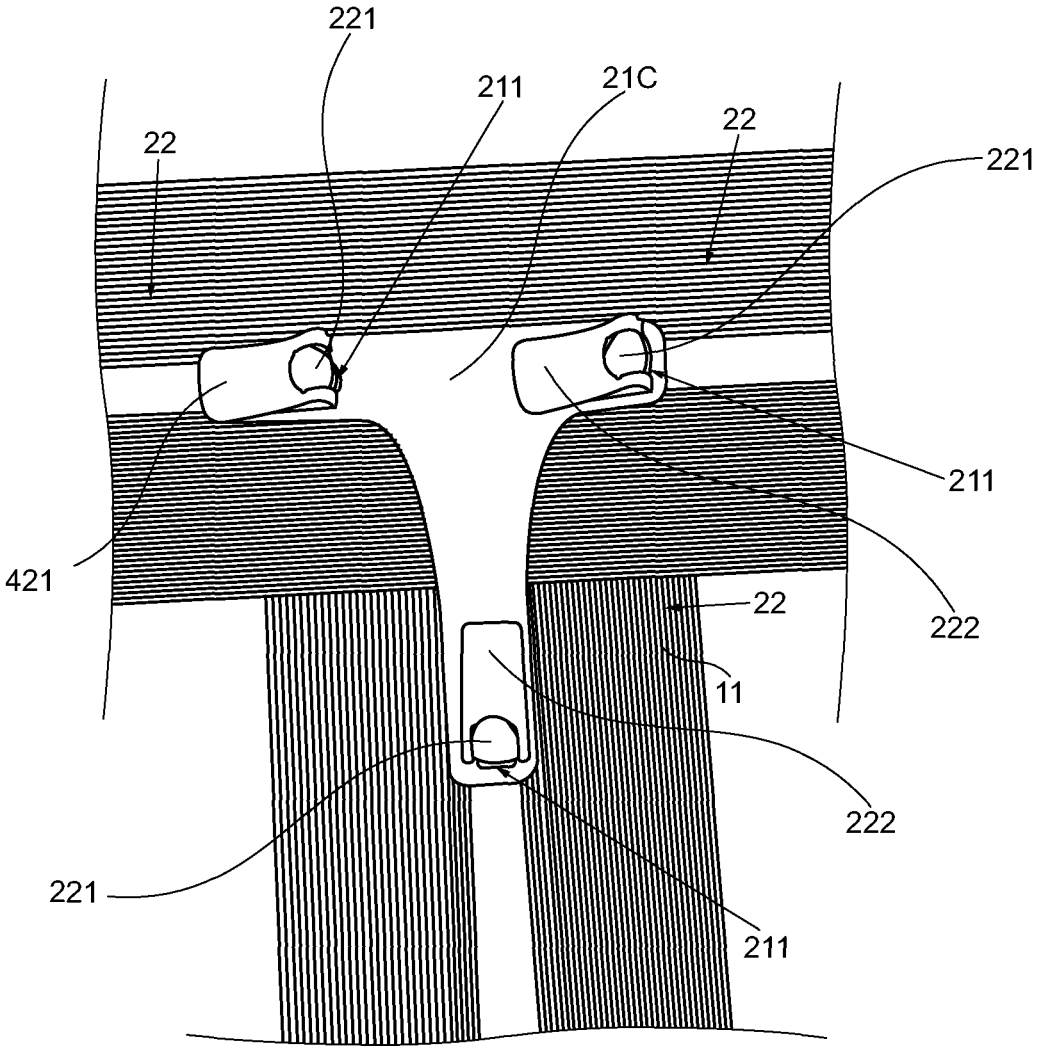
FIG. 13 is a perspective view of the third alternative mode of the main portion of the connector according to the aspect of the embodiment, illustrating the connector being configured to connect with two adjacent supporting frames.

In still yet another embodiment, as shown in FIG. 12 and FIG. 13, a third alternative mode of the main portion 21C is a T-shaped plate 21C having at least one connecting through hole 211, wherein each of the connecting through hole 211 are arranged on a corresponding endpoint of three endpoints of the T-shaped plate 21C, wherein three connecting portions 22 are arranged on three endpoints of the T-shaped plate 21C. In other words, three connecting through holes 211 are formed on three endpoints of the T-shaped plate 21C.

The two connecting portions 22 of the T-shaped plate 21C can be affixed on the transversely-arranged supporting frame 11, and the rest connecting portions 22 on the T-shaped plate 21C can be affixed on the horizontally-arranged supporting frame 11, wherein the transversely-arranged 1 frame 1 is vertically arranged with the horizontally-arranged supporting frame 11 to form a flat surface, and the transversely-arranged supporting frame 11 and the horizontally-arranged supporting frame 11 are connected by the T-shaped plate 21C to form a 90-degree angle.

Figure 14:
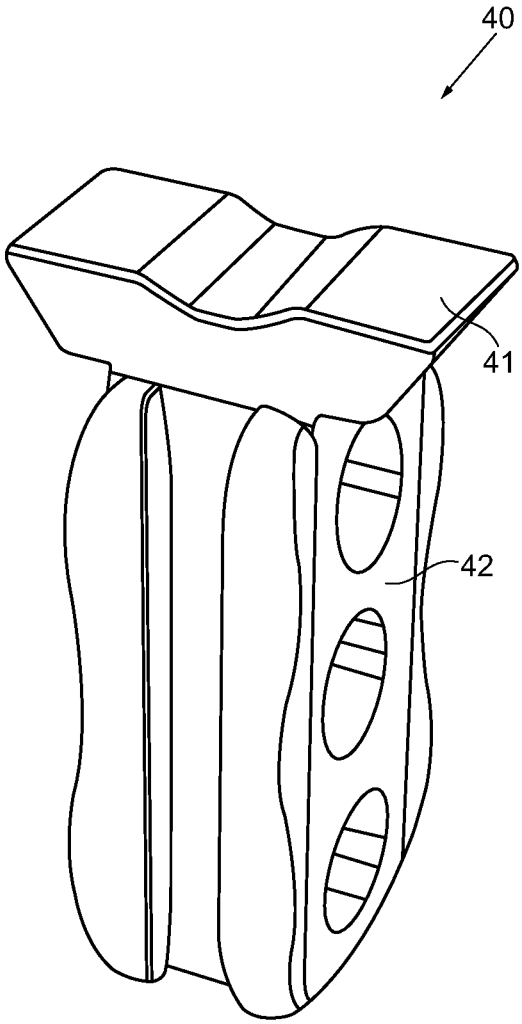
FIG. 14 is a perspective view of a second connector according to the aspect of the embodiment.
Figure 15:
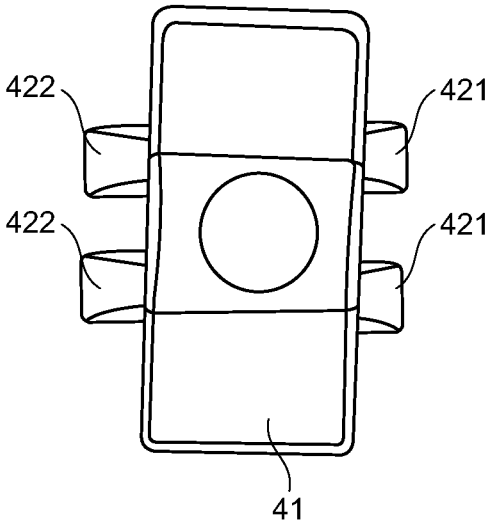
FIG. 15 is a top view of the second connector according to the aspect of the embodiment.
Figure 16:
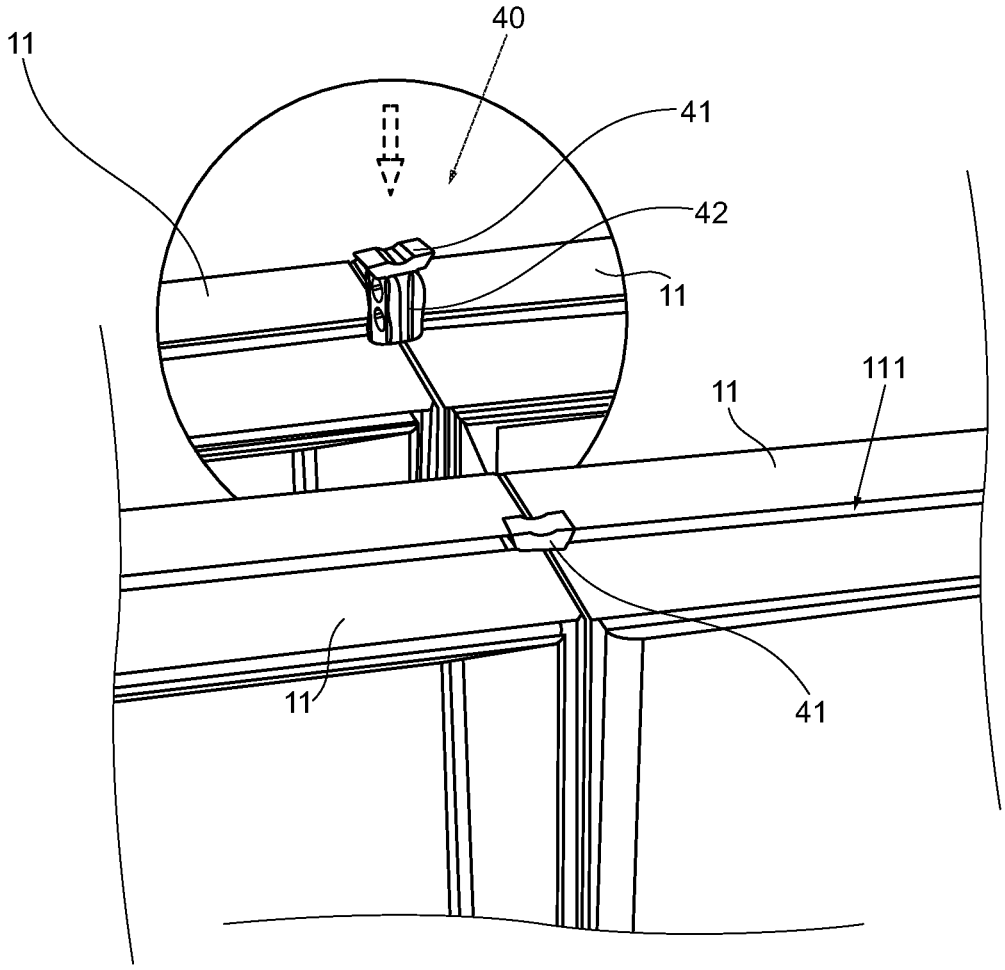
FIG. 16 is a perspective view of the second connector according to the aspect of the embodiment, illustrating the second connector being configured to connect with two adjacent supporting frames.

Referring to FIGS. 14 to 16, the display frame further comprises a first connector 40 having a top portion 41 and an elongated second portion 42 integrally extended from the top portion 41, wherein the elongated second portion 42 comprises a first pair of protrusion 421 formed on a right side of the elongated second portion 42 and a second pair of protrusion 422 formed on a left side of the elongated second portion 42, wherein the first pair of the protrusion 421 can be slid along the receiving slot 111 of one supporting frame 11, and the second pair of the protrusion 422 can be slid along the receiving slot 111 of the other supporting frame 11 to connect the two adjacent supporting frames 11, and in this manner, the top surface 12 of the one supporting frame 11 is overlapped with the top surface 12 of the other support frame 11.

Figure 17:
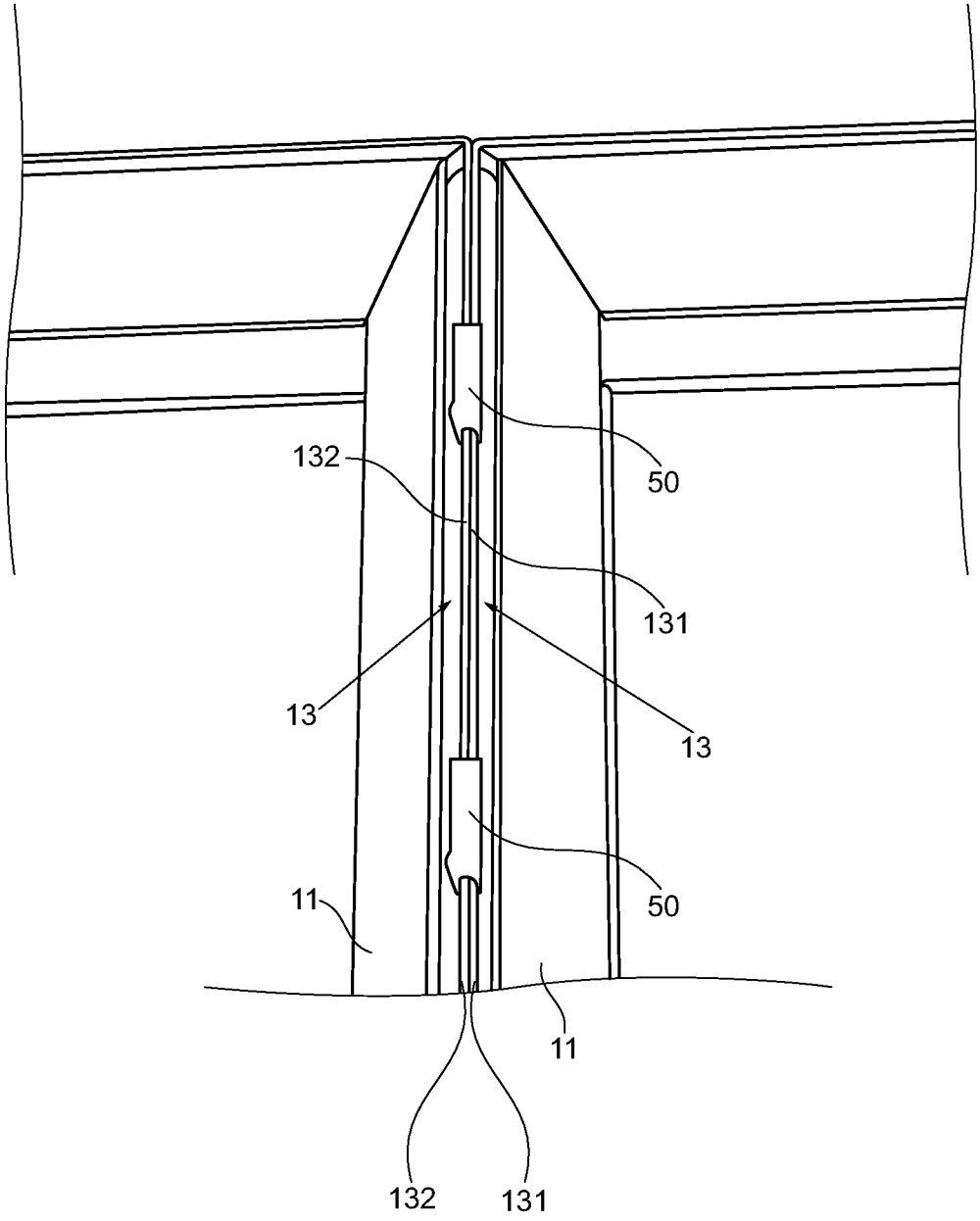
FIG. 17 is a perspective view of a third connector according to the aspect of the embodiment.
Figure 18:
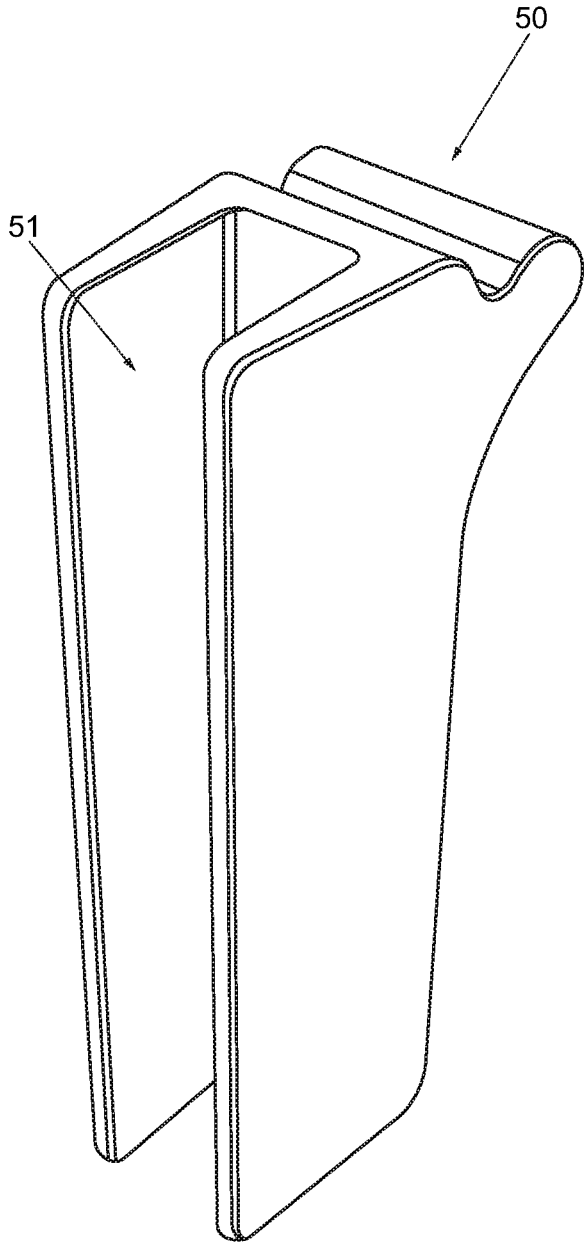
FIG. 18 is a perspective view of the third connector according to the aspect of the embodiment, illustrating the third connector being configured to connect with two adjacent supporting frames.

Referring to FIG. 17 and FIG. 18, each of the supporting frames 11 further comprises at least one peripheral groove 13 arranged at least one side of each of the supporting frames 11, wherein each of the peripheral grooves 13 naturally forms a right periphery 131 and a left periphery 132.

In one embodiment, the display frame further comprises a second connector 50 having a retaining slot 51 for receiving the right and left periphery 131, 132, wherein the top surfaces 12 of two supporting frames 11 can be overlapped with each other, and then the right periphery 131 of the peripheral groove 13 of one supporting frame 11 is overlapped with the left periphery 132 of the peripheral groove 13 of the other supporting frame 11. In this way, the right periphery 131 of the peripheral groove 13 of one supporting frame 11 and the left periphery 132 of the peripheral groove 13 of the other supporting frame 11 can be received into the retaining slot 51, so as to connect the two overlappedly-arranged supporting frames 11.

A method for assembling display frames, comprising:

Provide at least one supporting frame having a receiving slot formed thereon;

Provide at least one connector detachably affixed on one supporting frame; and

Affix the at least one connector on the supporting frame to connect two supporting frames.

In one embodiment, the connector comprises at least one connecting portion configurated to affix on the supporting frame, wherein the connecting portion comprises a middle portion, an operating element pivotally connected to a side of the middle portion, and a retaining portion integrally extended from an opposite side of the middle portion, wherein the middle portion can be rotatably received inside the connecting through hole.

In another embodiment, the connector comprises a main portion having at least one connecting through hole for receiving the middle portion of the connecting portion.

In still yet another embodiment, the method further comprises a step of:

Slide the retaining portion along with the receiving slot and push the operating element biased against the main portion to lock the connecting portion with the receiving slot.

Pull up the operating element to release the retaining portion from the receiving slot.

Similarly, while operations and/or methods may be depicted in the drawings in a particular order, this should not be understood as requiring that such operations be performed in the particular order shown or in sequential order, or that all illustrated operations and/or method steps be performed, to achieve desirable results. In certain circumstances, multitasking and parallel processing may be advantageous.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more or different elements, which are disclosed herein even when not initially claimed in such combinations.

Thus, specific embodiments and applications of connectors for the display frame have been disclosed. It should be apparent, however, to those skilled in the art that many more modifications besides those already described are possible without departing from the disclosed concepts herein. The disclosed embodiments, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the embodiments. In addition, where the specification and claims refer to at least one of something selected from the group consisting of A, B, C . . . and N, the text should be interpreted as requiring at least one element from the group which includes N, not A plus N, or B plus N, etc.

The words used in this specification to describe the various embodiments are to be understood not only in the sense of their commonly defined meanings but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims, therefore, include not only the combination of elements which are literally set forth but all equivalent structure, material or acts for performing substantially the same function in substantially the same way to obtain substantially the same result. In this sense, it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. A display frame, comprising:

at least one supporting frame having a receiving slot; and at least one connector comprising a main portion and at least one connecting portion rotatably arranged on the main portion, the connecting portion comprising a middle portion, an operating portion pivotally connected on a side of the middle portion, and a retaining portion integrally extended from an opposite side of the middle portion, the main portion comprising a top surface and a bottom surface, wherein the retaining portion can be operated to biased against the bottom surface of the main portion, the main portion further comprising at least one connecting through hole configured to receive the middle portion of the connecting portion, the retaining portion having a size larger than a diameter of the connecting through hole, the middle portion of the connecting portion being operable to pass through the connecting through hole, and being rotatably received in the connecting through hole, wherein the connecting portion slidably advances along the receiving slot and can be rotated to lock on the supporting frame, wherein two connecting portions are operable to affix with two separate supporting frames respectively, so as to connect the two supporting frames.

2. The display frame, as recited in claim 1, wherein the retaining portion is an elongated block, wherein the retaining portion can be vertically-arranged to insert into the receiving slot and slide along with the receiving slot to a corresponding location, and then the retaining portion can be rotated 90 degrees in a horizontal position.

3. The display frame, as recited in claim 2, wherein the main portion comprises a first portion, a second portion vertically extended from the first portion, and a third portion integrally extended from the second portion to form a 45-degree angle.

4. The display frame, as recited in 3, wherein one connecting portion is arranged on an endpoint of the first portion, and the other connecting portion is arranged on an endpoint of the third portion.

5. The display frame, as recited in claim 2, wherein the main portion is a T-shaped plate, wherein three connecting portions are arranged on three ends of the T-shaped plate.

6. The display frame, as recited in claim 1, wherein the operating portion is pushed towards the main portion to lock the retaining portion on the corresponding location.

7. The display frame, as recited in claim 1, wherein the operating portion can be pulled up in a vertical position to release the retaining portion from the receiving slot.

8. The display frame, as recited in claim 1, wherein the main portion comprises a first portion and a second portion vertically extended from the first portion, wherein two connecting portions are arranged on endpoints of the first and second portions respectively.

9. The display frame, as recited in claim 1, wherein the main portion is an elongated plate.

10. A method for assembling display frames, comprising:

providing supporting frames having a receiving slot formed thereon;

providing at least one connector detachably affixed on one of the supporting frames;

affixing the at least one connector on another supporting frame to connect two adjacent supporting frames;

affixing at least one connecting portion arranged on the connector on the another supporting frame, the connecting portion comprises a middle portion, an operating portion pivotally connected to a side of the middle portion, and a retaining portion integrally extended from an opposite side of the middle portion;

the connector comprises a main portion having at least one connecting through hole for receiving the middle portion of the connecting portion;

wherein the middle portion can be rotatably received inside the connecting through hole;

sliding the retaining portion along with the receiving slot and pushing the operating portion biased against the main portion to lock the connecting portion with the receiving slot;

rotating the connecting portion with the supporting frame and lock the connecting portion on the supporting frame.

11. The method, as recited in claim 10, further comprising pulling up the operating portion to release the retaining portion from the receiving slot.

* * * * *